US007389556B2

(12) United States Patent
Parton

(10) Patent No.: US 7,389,556 B2
(45) Date of Patent: Jun. 24, 2008

(54) GOLF BALL CLEANING MACHINE

(76) Inventor: James Donald Parton, 2394 Temple Dr., Medford, OR (US) 97504

( * ) Notice: Subject to any disclaimer, the term of this patent is extended or adjusted under 35 U.S.C. 154(b) by 71 days.

(21) Appl. No.: 11/518,588

(22) Filed: Sep. 7, 2006

(65) Prior Publication Data

US 2008/0060147 A1 Mar. 13, 2008

(51) Int. Cl.
*A63B 47/04* (2006.01)

(52) U.S. Cl. ..... 15/21.2; 15/3.16

(58) Field of Classification Search ..... 15/3.13, 15/3.16, 3.19, 3.2, 3.21, 21.2
See application file for complete search history.

(56) References Cited

U.S. PATENT DOCUMENTS 1,876,851 A * 9/1932 Burg ..... 15/21.2
2,005,115 A * 6/1935 Stutz ..... 15/21.2
3,099,027 A * 7/1963 Illo ..... 15/21.2
4,970,746 A * 11/1990 Brackmann ..... 15/21.2
6,269,509 B1 * 8/2001 Mays ..... 15/21.2

FOREIGN PATENT DOCUMENTS

JP 4-297282 * 10/1992
JP 7-100229 * 4/1995
JP 2001-70905 * 3/2001

* cited by examiner

*Primary Examiner*—Mark Spisich

(57) ABSTRACT

A golf ball cleaning machine is provided that is either a fixed mount or portable design and which includes a housing of two hinged halves that open and close. The upper housing includes a feeder tube with a ball inlet and the lower housing including a ball scrubbing material as well as an auger mechanism. Cleaning action results from an external hand cranking of the auger which moves the ball while it is engaged with the scrubbing material. A plurality of balls may be located within the feeder tube and which are sequentially cleaned in the lower housing. Cleaned balls are retains in a cleaning compartment.

1 Claim, 3 Drawing Sheets

GOLF BALL CLEANING MACHINE

BACKGROUND

Cleaning devices for cleaning golf balls are common in the art. The most common types of ball cleaners only clean one ball at a time. It is felt that there is a need for a simple device which is capable of cleaning plural balls at the same time and which may be provided in either a portable or a fixed installation.

SUMMARY

The present invention provides a ball cleaning machine which enables the user to sequentially clean a plurality of balls at the same time. The invention includes upper and lower housing portions which are hinged to together. The upper housing includes a ball inlet which is capable of holding up to six balls and which upper housing is in communication with the lower housing. The lower housing includes a ball conveyor in the form of an auger mechanism as well as a ball scrubbing material. After cleaning, the balls are retained in a compartment so that the user need not remove the cleaned ball in order to clean the next one (as is required in the "single-ball" cleaners of the known prior art).

DETAILED DESCRIPTION OF THE INVENTION

Figure 1:
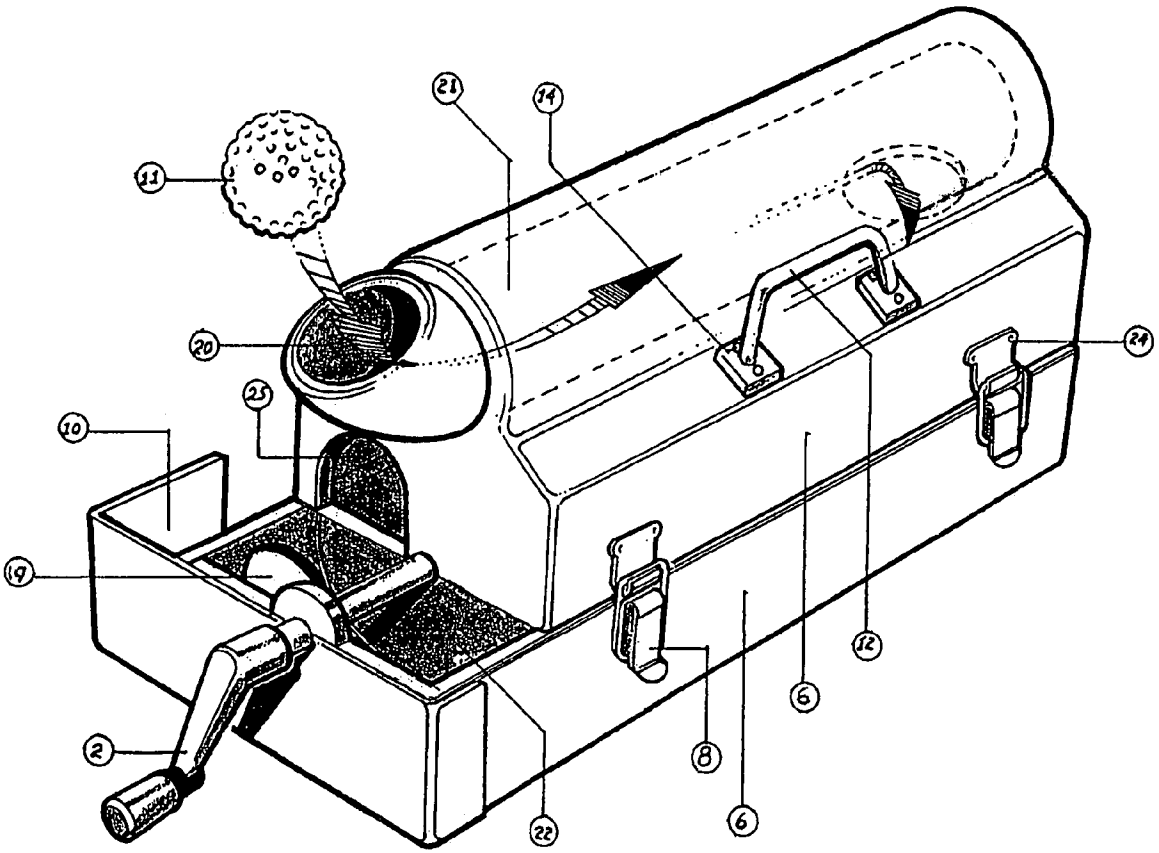
FIG. 1 is a view of the cleaning machine in the closed position.
Figure 2:
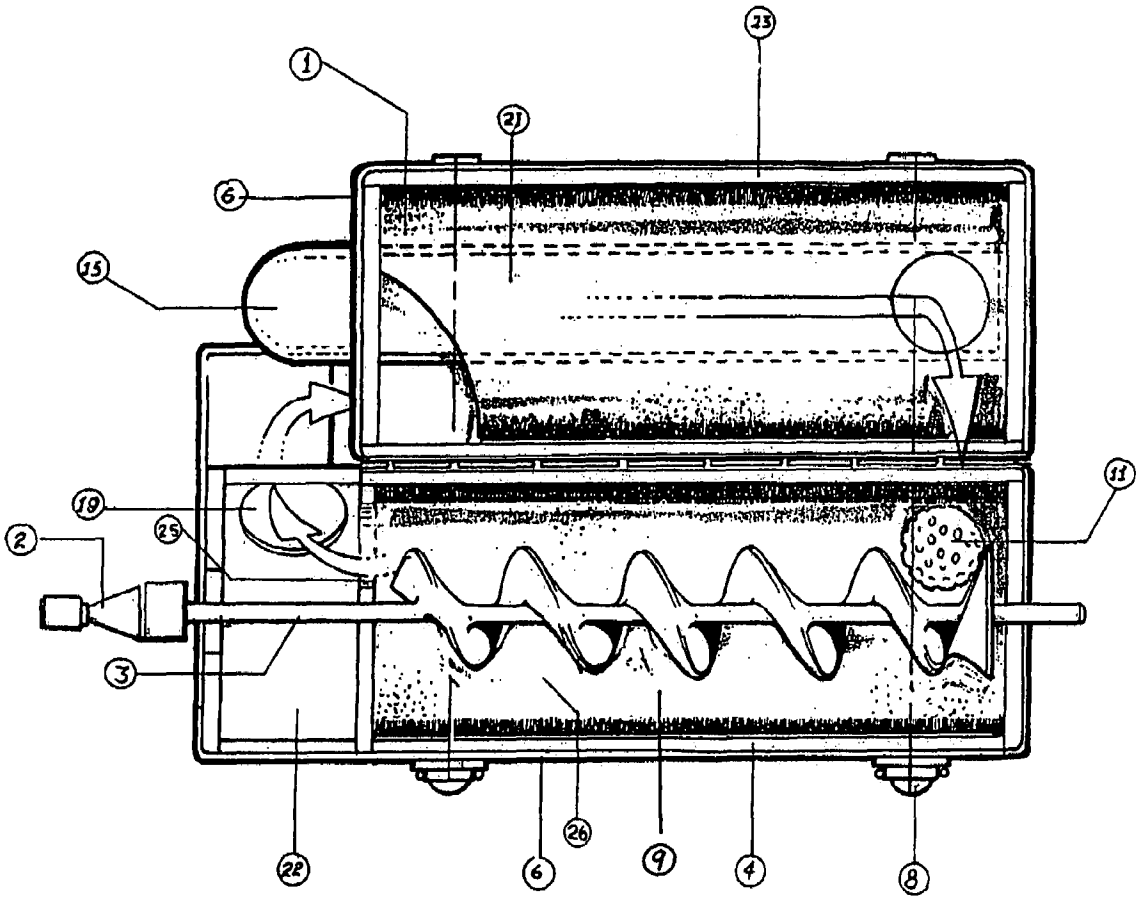
FIG. 2 is a view of the cleaning machine on the open position.

The golf ball cleaning machine is shown in its closed position in FIG. 1. The machine is comprising of upper and lower housing portions (6) coupled together with a hinge (18) so as to be opened (FIG. 2) and closed (FIG. 1) by the user. The two housing portions are retained in the closed position by a pair of latches (7,8), with the latches secured to the housing with mounting screws. The upper housing portion includes a top (23) is further provided with a handle (12) secured by screws (14).

The upper housing portion includes a feeder tube (21) extending along the length thereof. An end of the feeder tube (21) includes a ball entrance (20) into which a golf ball (11) may be inserted by the user. The length of the feeder tube (21) is such that up to six golf balls may be located therein for batch cleaning. The other end of the feeder tube (21) includes a opening (17) in communication with the lower housing. The lower housing includes a ball cleaning compartment (26) which includes a auger mechanism (3) extending along the length thereof and also a scrubbing material (1,9) which cleans the ball as it moved by the auger to travel along the length of the cleaning compartment from the end adjacent the opening (17) back to the end adjacent the feeder tube entrance (20). A manual crank (2) is provided at the end of the auger so as provide rotary motion. The cleaning compartment is further capable of containing a quantity of mild detergents, mild soaps or other mixtures of cleaning agents. The cleaned ball exits the cleaning compartment (27) through an exit opening (25).

After exiting the cleaning compartment through the opening (25), the cleaning ball enters a cleaned ball compartment (22) of the lower housing. The ball then enters a ball chute (10) through an exit opening (19).

Figure 3:
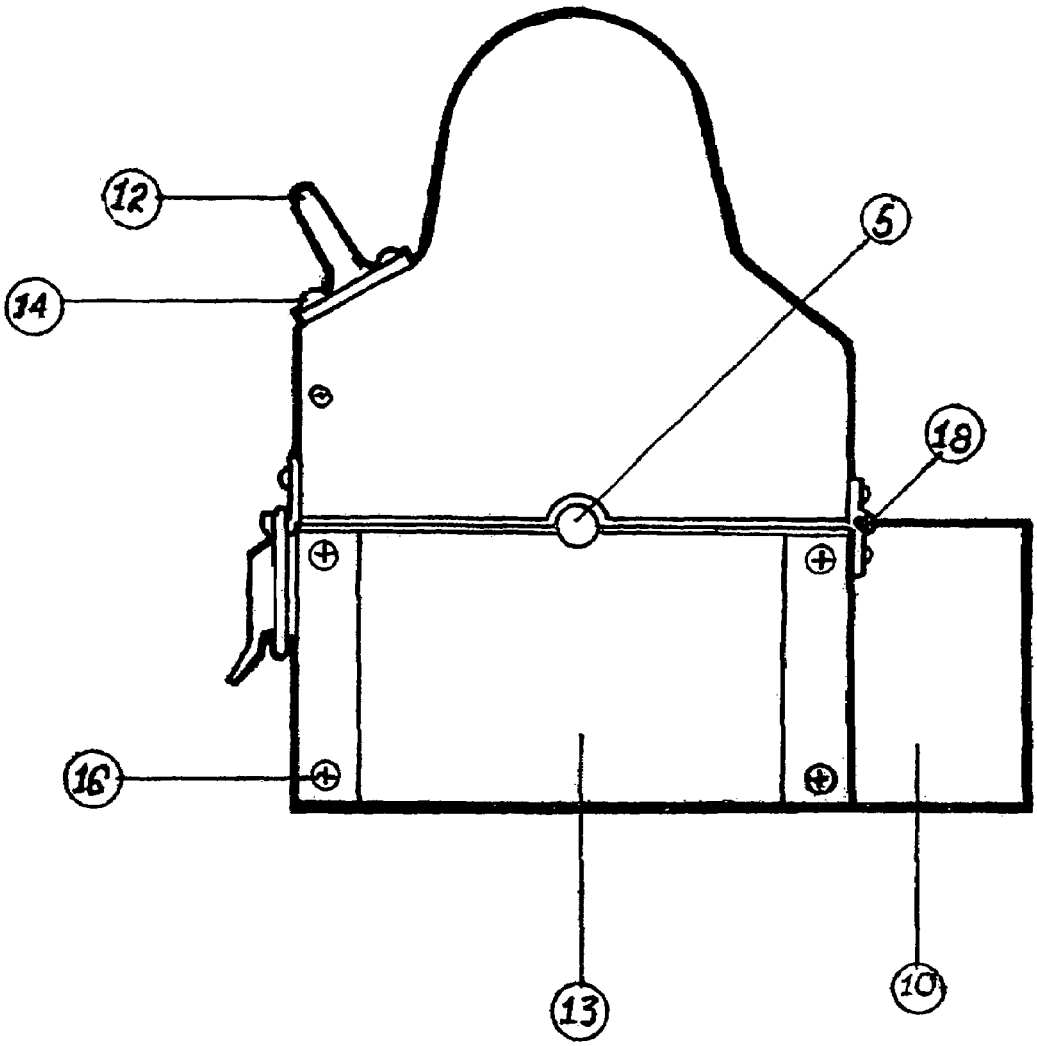
FIG. 3 is end view of the cleaning machine.

FIG. 3 shows an end view of the cleaning machine with the end wall (13) of the lower housing shown secured with screws (16) and the end (5) of the auger (3) being shown as well. The various components of the machine may be fabricated of a variety of materials such as aluminum, stainless steel or plastic.

The invention claimed is:

1. A golf ball cleaning machine comprising:

a) a housing comprising upper and lower housing members, the housing members being coupled to each other by a hinge such that they are adapted to be opened and closed by the user, the housing members further including latch means for retaining them in a closed position, each of the housing members being elongated and having opposite first and second ends;

b) the upper housing member including a feeder tube extending along the length thereof, the feeder tube including a ball inlet at the first end of the upper housing and the feeder tube including an outlet at the second end of the upper housing in communication with the lower housing;

c) the lower housing defining a cleaning compartment extending along the length thereof, the cleaning compartment of the lower housing adapted to contain a quantity of cleaning agent, the cleaning compartment including a ball-conveying auger extending along the length of the lower housing from the second to the first end thereof, the auger including a hand crank at an end of the auger adjacent the first end of the lower housing, the cleaning compartment including a scrubbing means which cleans the balls as they are moved by the auger from the second to the first end of the lower housing;

d) the length of the upper housing being shorter than that of the lower housing and further wherein a cleaned ball compartment is defined in the lower housing at the first end thereof; and e) whereby a ball to be cleaned is introduced into the ball inlet of the feed tube, travels along the length of the feed tube to the second end of the upper housing, drops down into the cleaning compartment in the lower housing at the second end thereof, travels along the length of the cleaning compartment by means of the auger back to the first end of the lower housing and the cleaned ball compartment.

* * * * *